US011627800B2

(12) United States Patent
Carrasco López

(10) Patent No.: US 11,627,800 B2
(45) Date of Patent: Apr. 18, 2023

(54) MODULAR SHELVING

(71) Applicant: AR SHELVING SOCIEDAD ANONIMA, Galdacano (ES)

(72) Inventor: José Ignacio Carrasco López, Galdacano (ES)

(73) Assignee: AR SHELVING SOCIEDAD ANONIMA, Galdacano (ES)

( * ) Notice: Subject to any disclaimer, the term of this patent is extended or adjusted under 35 U.S.C. 154(b) by 0 days.

(21) Appl. No.: 16/942,285

(22) Filed: Jul. 29, 2020

(65) Prior Publication Data

US 2021/0030149 A1 Feb. 4, 2021

(51) Int. Cl.

*A47B 57/44* (2006.01)
*A47B 57/34* (2006.01)
*A47B 47/00* (2006.01)

(52) U.S. Cl.

CPC ..... *A47B 57/44* (2013.01); *A47B 47/0083* (2013.01); *A47B 57/34* (2013.01)

(58) Field of Classification Search

CPC ..... A47B 57/44; A47B 47/0083; A47B 57/34; A47B 57/30; A47B 57/402; A47B 96/065; A47B 2230/08; A47B 57/545; A47B 57/265; A47B 91/022; A47B 57/26; A47B 81/00; A47B 91/02; A47B 96/06; A47B 57/18; A47B 47/045; A47B 96/063; A47B 96/068; A47B 2031/004; A47B 96/066; A47B 57/06; A47B 47/00; A47B 96/02; A47B 47/0008; A47B 47/021; A47B 47/024; A47B 57/08; A47B 57/10; A47B 96/024; A47B 57/54; A47B 57/565; A47B 2230/0018

USPC ..... 211/135, 134, 187, 186; 248/247, 248, 248/235, 240.1, 239, 243, 245, 300, 250; 108/106, 107, 147.11–147.17, 147.21

See application file for complete search history.

(56) References Cited

U.S. PATENT DOCUMENTS 1,577,066 A * 3/1926 Philips ..... A47B 57/40 108/109
1,667,913 A * 5/1928 Weston ..... A47B 57/18 211/133.1
1,952,111 A * 3/1934 Bales ..... A47B 57/425 108/107
3,082,711 A * 3/1963 Vetere ..... A47B 57/265 108/107
3,120,201 A * 2/1964 Kates ..... A47B 57/26 108/147.15
3,255,722 A * 6/1966 Ferdinand ..... F16B 12/50 108/147.15
3,422,775 A * 1/1969 Erik ..... A47B 57/16 108/109
3,479,975 A * 11/1969 Handler ..... A47B 57/20 108/147.12

(Continued)

*Primary Examiner* — Devin K Barnett
(74) *Attorney, Agent, or Firm* — Perry + Currier Inc.

(57) ABSTRACT

Quadrangular shelving comprising four bars with sets of four first pairs of holes, wherein the location of said sets defines different heights of the shelving for establishing the quadrangular trays, a set of quadrangular trays, wherein each tray comprises four corners and wherein each corner forms an opening and comprises a second pair of holes, the shelving comprises for each tray of the set of quadrangular trays: four plates, a pair of screws adapted to screw each plate and wherein the plate covers the opening.

4 Claims, 4 Drawing Sheets

(56) References Cited

U.S. PATENT DOCUMENTS

| | | | | | |
|---|---|---|---|---|---|
| 3,881,428 | A * | 5/1975 | Klecki | A47B 47/03 | 108/27 |
| 3,981,250 | A * | 9/1976 | Anthony | A47B 57/26 | 108/106 |
| 4,064,995 | A * | 12/1977 | Bustos | A47B 57/402 | 211/187 |
| 4,132,178 | A * | 1/1979 | Mueller | F16B 12/52 | 108/147.14 |
| 4,645,276 | A * | 2/1987 | Flavigny | A47B 57/44 | 108/107 |
| 4,742,782 | A * | 5/1988 | Miller | A47B 47/024 | 108/107 |
| 5,425,520 | A * | 6/1995 | Masumoto | A47B 96/06 | 248/247 |
| 5,463,966 | A * | 11/1995 | Nilsson | F16B 12/34 | 108/110 |
| 5,957,060 | A * | 9/1999 | Rosenband | A47B 57/22 | 108/107 |
| 6,527,236 | B1 * | 3/2003 | Situ | A47B 57/26 | 248/220.1 |
| 2015/0282613 | A1 * | 10/2015 | Chen | A47B 96/1408 | 211/187 |
| 2019/0290000 | A1 * | 9/2019 | Davis | A47B 57/34 | |

* cited by examiner

MODULAR SHELVING

OBJECT OF THE INVENTION

The present invention belongs to the field of modular shelving.

The object of the present invention is to provide fixing plates for modular shelving that allow the trays to be fastened to the structure formed by four bars of the modular shelving.

BACKGROUND OF THE INVENTION

The existing modular shelving on the market has serious stability problems due to their modular composition. The trays that make up the shelving usually have openings in their corners that advantageously allow them to be stacked for storage and distribution, but which increase the instability of the shelving once they have been assembled. Therefore, there is a demand for a solution for attaching the shelving that does not hinder the usual assembly, but complements it by increasing the stability of the shelving.

DESCRIPTION OF THE INVENTION

The present invention relates to modular shelving, in particular to quadrangular shelving supported on four bars comprising sets of holes, in particular sets of four pairs of holes. The location of these sets defines different heights of the shelving for establishing trays.

The shelving also comprises a set of quadrangular trays, wherein each tray comprises four corners and wherein an opening and a second pair of holes are established at each corner. Thus, each tray comprises four pairs of holes dimensioned to coincide with a set of four pairs of holes on the bars of the shelving.

The shelving comprises for each tray of the set of quadrangular trays four fixing plates. Each plate is formed by a first sector angled at 90 degrees with a second sector. The first sector and the second sector comprise a first and a second hole, respectively. The first and second holes are dimensioned to coincide in diameter with a pair of holes on a corner of the tray and with a pair of holes on one of the bars of the shelving.

In addition, the shelving includes screws designed to screw each plate to said corner of the tray and to the shelving bar through the holes on the plate, the pair of holes on the corner of the tray, and the pair of holes on the bar. Each fixing plate covers the opening in the corner of the tray increasing the stability of the modular shelving.

PREFERRED EMBODIMENT OFF THE INVENTION

Figure 1:
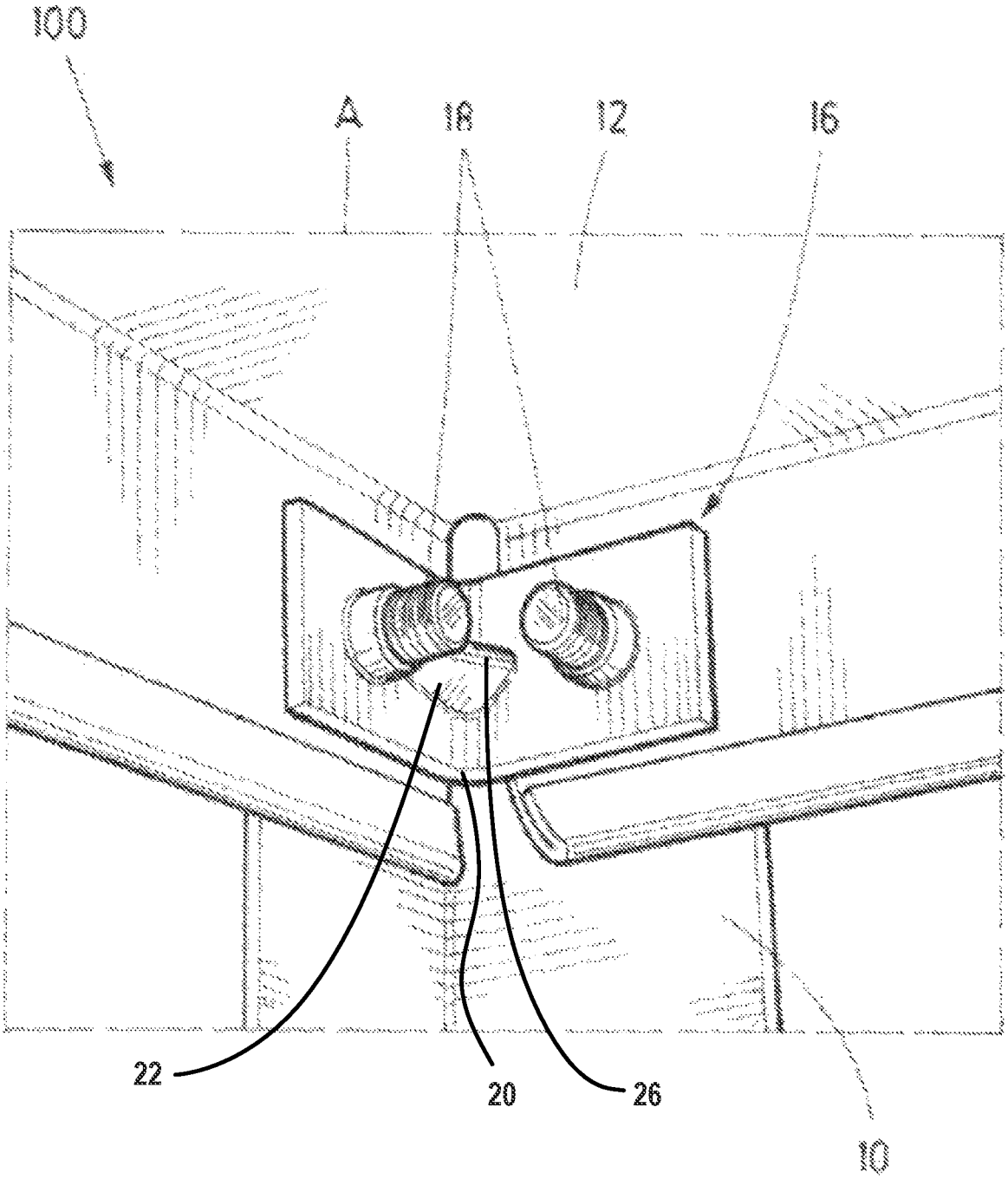
FIG. 1 is a sectional view of the shelving according to the present invention.
Figure 4:
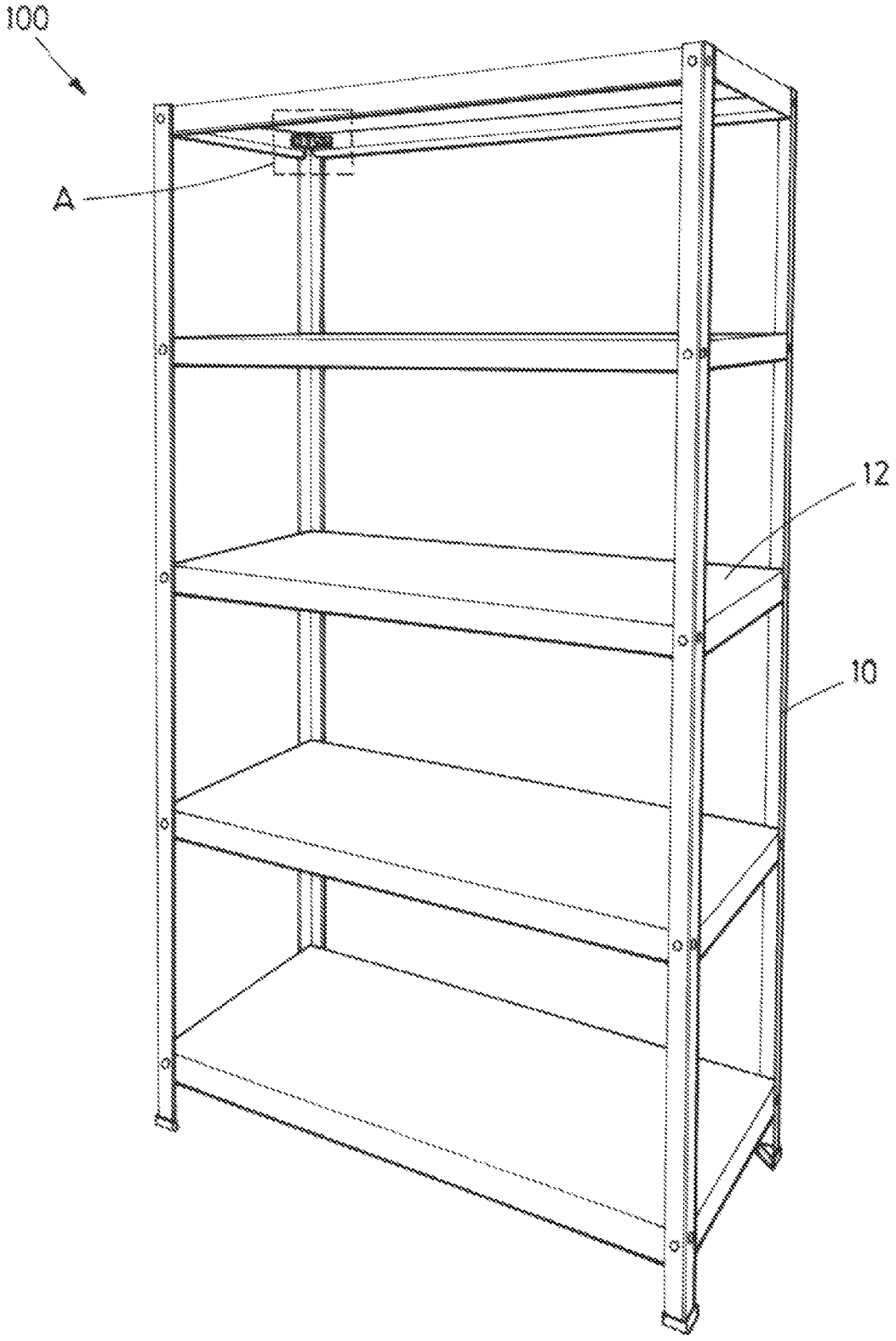
FIG. 4 shows the shelving according to the present invention.

FIG. 1 represents a view A of a section of the modular shelving (100) according to the present invention (which is shown in FIG. 4). This section shows a bar (10) that is part of the shelving (100), a tray (12) and a fixing plate (16), in addition to some screws (18) that are screwed to the fixing plate (16) allow the fixing plate (16) to be screwed to the tray (12) and to the bar (10) of the shelving (100) increasing the stability of the modular shelving (100).

The set of trays (12) together with the four bars (10) that make up the shelving (100) can be seen in FIG. 4, which also shows the view A of FIG. 1. The shelving (100) is a quadrangular shelving with rectangular shape that includes four bars (10) with holes (which are not seen in the figure) that define the heights of the shelving (100) for placing the trays (12). As can be seen in FIG. 4, the shelving (100) comprises, for example, 5 rectangular trays for this preferred embodiment. In other embodiments, the trays can be square-shaped and the number of trays can vary.

Figure 2:
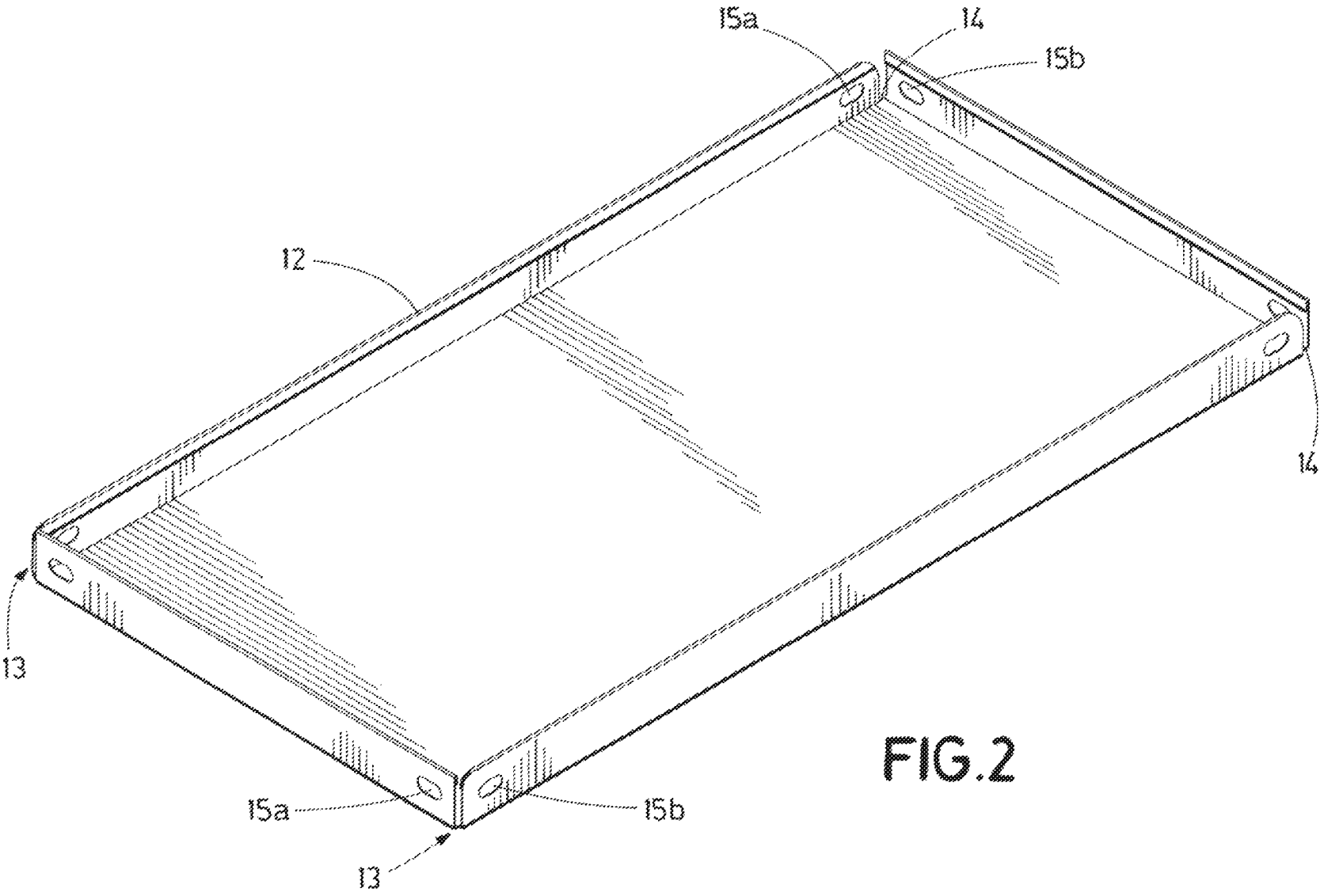
FIG. 2 shows the tray that is part of the shelving according to the present invention.

FIG. 2 shows an example of a tray (12). The tray (12) comprises four corners (13) wherein an opening (14) is established. Said openings (14) allow the stacking of two or more trays (13) for storage and transport. Furthermore, each corner (13) comprises a pair of holes (15*a*, 15*b*) for attaching the tray to the bars (10) of the shelving (100).

Figure 3A:
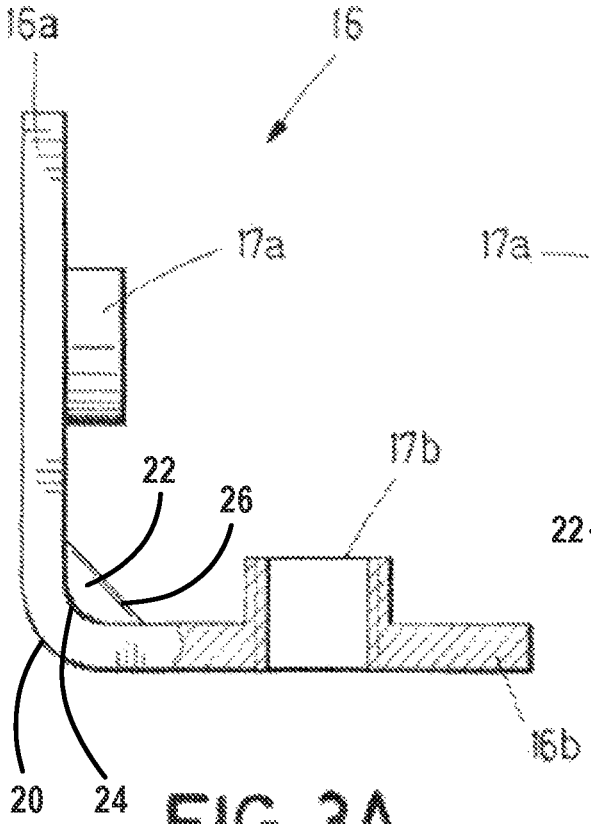
FIGS. 3A, 3B and 3C show the fixing plate according to the present invention.
Figure 3B:
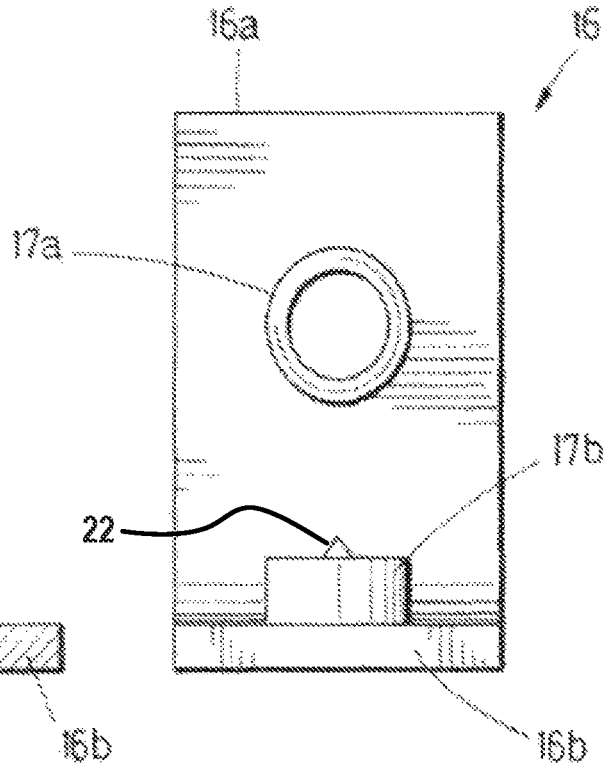
Figure 3C:
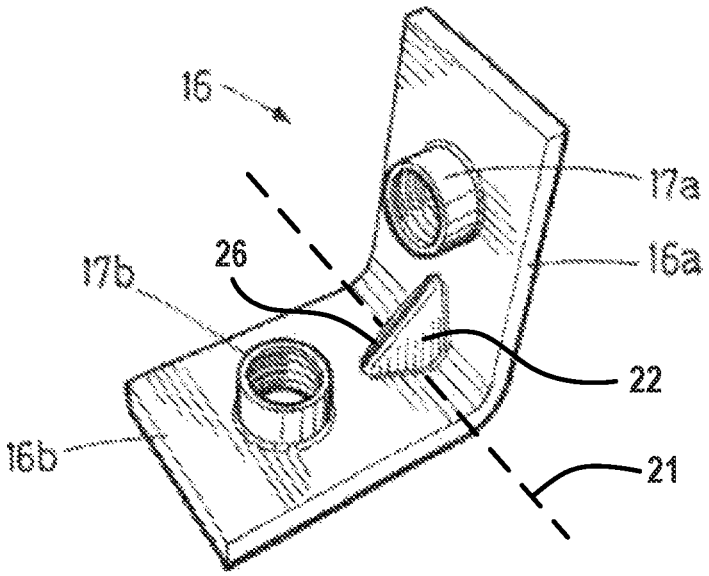

FIGS. 3A, 3B and 3C show a fixing plate (16) according to the present invention, each plate is formed by a first sector (16*a*) angled at 90 degrees with a second sector (16*b*) as seen in the FIG. 3A. The first and second sectors (16*a*, 16*b*) meet at a plate corner of the plate (20) (i.e., substantially a line of intersection (21) between the first and second sectors (16*a*, 16*b*)). The first and second sectors (16*a*, 16*b*) define an inner side of the plate as respective surfaces of the first and second sectors (16*a*, 16*b*) having an angle of 90 degrees between them, and an outer side of the plate (16) as respective surfaces of the first and second sectors (16*a*, 16*b*) having an angle of 270 degrees between them. The first sector (16*a*) includes first barrel extending from the inner side of the plate (16) defining a third hole (17*a*). The first barrel is integral with the plate (16) and has a first threaded interior. The second sector (16*b*) includes a second barrel extending from the inner side of the plate (16) defining a fourth hole (17*b*). The second barrel is also integral with the plate (16) and has a second threaded interior). The first and second barrels may be substantially cylindrical in shape. The third and fourth holes (17*a*, 17*b*) are adapted to match or coincide in diameter with the pair of holes (15*a*, 15*b*) of the corner (13) of the tray (12) and at the same time, said pairs of holes (17*a*, 17*b*) and (15*a*, 15*b*) are adapted to match a pair of holes on the bar (10). In particular, the outer side of the plate (16) is configured to abut one of the corners (13) of the tray (12) such that the third and fourth holes (17*a*, 17*b*) of the plate (16) are aligned with a pair of the first holes (15*a*, 15*b*) of the tray (12) and a pair of the holes of the bar (10).

Additionally, the plate (16) may include a brace (22) at the inner side of the plate (16) between the first sector (16*a*) and the second sector (16*b*), the brace (22) configured to maintain and support the first and second sectors (16*a*, 16*b*) at 90 degrees. In particular, the brace (22) is a tetrahedral brace which extends from the plate corner (20) such that a first edge (24) of the tetrahedral brace extends along the plate corner (20), and a second edge (26) of the brace opposite the first edge (24) extends between the first sector (16*a*) and the second sector (16*b*) on the inner side of the plate. That is, the first edge (24) is substantially aligned with the plate corner (20), and extends along the line of intersection (21) between the first and second sectors (16*a*, 16*b*). The second edge (26) of the brace opposite said first edge (i.e., the edge of the tetrahedral brace which does not share any vertices with the first edge) extends between the first and second sectors (16*a*, 16*b*). That is, the second edge (26) has its first endpoint on the first sector (16*a*), and its second endpoint on the second sector (16*b*). Preferably, the second edge (26) is a straight edge.

Thus, the pairs of screws (18) shown in FIG. 1 are adapted to screw each plate (16) to said corner of the tray (12) and to the shelving bar through the first and second holes of the plate (17*a*, 17*b*), the second pair of holes (15*a*, 15*b*) and the first pair of holes of the bar (10). In particular, each pair of screws (18) is adapted to be received through a respective pair of holes of the bar (10), a respective pair of first holes (15*a*, 15*b*) of the tray (12), and the third and fourth holes (17*a*, 17*b*) of the plate (16). Upon being received in the third and fourth holes (17*a*, 17*b*), the screws (18) mate with the first and second threaded interiors of the first and second barrels, respectively, to screw the plate (16) to a corner (13) of the tray (12) and to a respective one of the bars (10).

Screwing the plate (16) to the tray (12) and to the bar (10) of the shelving (100) contributes the attachment of said elements to each other and therefore the assembly of the modular shelving (100) which is shown in FIG. 4. Advantageously, screwing the fixing plate (16) connects the ends of the corner (13) of the tray (12) covering the opening (14). Consequently, the plate increases the stability of the shelving (100).

The invention claimed is:

1. A quadrangular shelving comprising:

a plurality of quadrangular trays wherein each quadrangular tray comprises four corners, and wherein each corner forms an opening and a pair of first holes;

four bars, wherein each bar comprises at least one pair of second holes, wherein locations of the at least one pair of second holes defines different heights of the shelving for mounting one of quadrangular trays;

a plurality of sets of four plates, each set of four plates corresponding to a respective quadrangular tray of the plurality of quadrangular trays, and wherein each plate comprises:

a first sector and a second sector, the first sector angled at 90 degrees with respect to the second sector to define an inner side of the plate and an outer side of the plate, wherein the first sector and the second sector meet at a plate corner of the plate;

a tetrahedral brace between the first sector and the second sector of the plate on the inner side of the plate, the tetrahedral brace extending from the plate corner such that a first edge of the tetrahedral brace extends along the plate corner, and a second edge of the tetrahedral brace opposite the first edge extends between the first sector and the second sector on the inner side of the plate; and a first barrel extending from the inner side of the plate at the first sector and defining a third hole in the first sector, the first barrel being integral with the plate and having a first threaded interior;

a second barrel extending from the inner side of the plate at the second sector and defining a fourth hole in the second sector, the second barrel being integral with the plate and having a second threaded interior;

wherein the third and fourth holes coincide in diameter with the pair of first holes of one of the corners of the respective quadrangular tray from the plurality of quadrangular trays and further coincide in diameter with a respective pair of the at least one pair of second holes on one of the four bars; and wherein the outer side of the plate is configured to abut one of the four corners of the respective quadrangular tray from the plurality of quadrangular trays such that the third and fourth holes of the plate are aligned with a pair of the first holes of one of the corners of the respective quadrangular tray and the respective pair of the at least one pair of second holes on one of the four bars and such that the plate covers a respective opening of the corner; and a plurality of sets of four pairs of screws, each set of four pairs of screws corresponding to the respective quadrangular tray, and wherein each pair of screws is adapted to be received through a respective pair of second holes of one of the bars, a respective pair of first holes of one the corners of one of the quadrangular trays, and the third and fourth holes of a respective plate to mate with the first threaded interior and the second threaded interior of the first and second barrels, respectively, to screw each plate to a corner of the respective quadrangular tray and to a respective one of the bars.

2. The quadrangular shelving of claim 1, wherein the first and second barrels are cylindrical.

3. The quadrangular shelving of claim 1, wherein the tetrahedral brace is configured to maintain the first sector and the second sector at 90 degrees.

4. The quadrangular shelving of claim 1, wherein the second edge of the tetrahedral brace comprises a straight edge.

* * * * *